United States Patent [19]

Einhorn

[11] 4,071,216

[45] Jan. 31, 1978

[54] WALL BRACKET ASSEMBLY

[75] Inventor: Ruediger Einhorn, Katonah, N.Y.

[73] Assignee: Coats & Clarke, Inc., Stamford, Conn.

[21] Appl. No.: 714,471

[22] Filed: Aug. 16, 1976

[51] Int. Cl.[2] ..... A47F 5/00

[52] U.S. Cl. ..... 248/290; 248/289 R

[58] Field of Search ..... 16/171; 248/124, 215, 248/235, 240, 240.3, 246, 282, 283, 289 R, 290, 296, 304, 305, 309 R, 311.1, 339, 340; 403/97

[56] References Cited

U.S. PATENT DOCUMENTS

| | | | |
|---|---|---|---|
| 214,741 | 4/1879 | Worthley | 248/289 |
| 257,202 | 5/1882 | Baer | 248/289 |
| 266,952 | 12/1882 | Simpson | 248/289 |
| 342,476 | 5/1886 | Swartwout | 248/289 X |
| 2,098,348 | 11/1937 | Mason et al. | 403/97 X |
| 2,469,981 | 5/1949 | Nelson | 248/289 |
| 3,920,210 | 11/1975 | Einhorn | 248/290 |
| 3,995,822 | 12/1976 | Einhorn et al. | 248/339 |

FOREIGN PATENT DOCUMENTS

| | | | |
|---|---|---|---|
| 651,467 | 8/1964 | Belgium | 248/311.1 |

*Primary Examiner*—James C. Mitchell

*Attorney, Agent, or Firm*—Burgess, Ryan and Wayne

[57] ABSTRACT

A wall bracket assembly has a wall plate with a pair of vertically spaced apart pivot pins adapted to pivotally hold a bracket arm. The pins may be noncircular to enable positioning of the bracket arm, and one pin may be longer than the other to facilitate assembly of the bracket. The bracket may have a tapered grooved end for receiving a hook or ring with a matching configuration. Alternatively, a saucer may have a grooved bottom adapted to be held on the top of the bracket arm and held in place by a hooked shaped element extending over the saucer edge.

18 Claims, 16 Drawing Figures

W
W

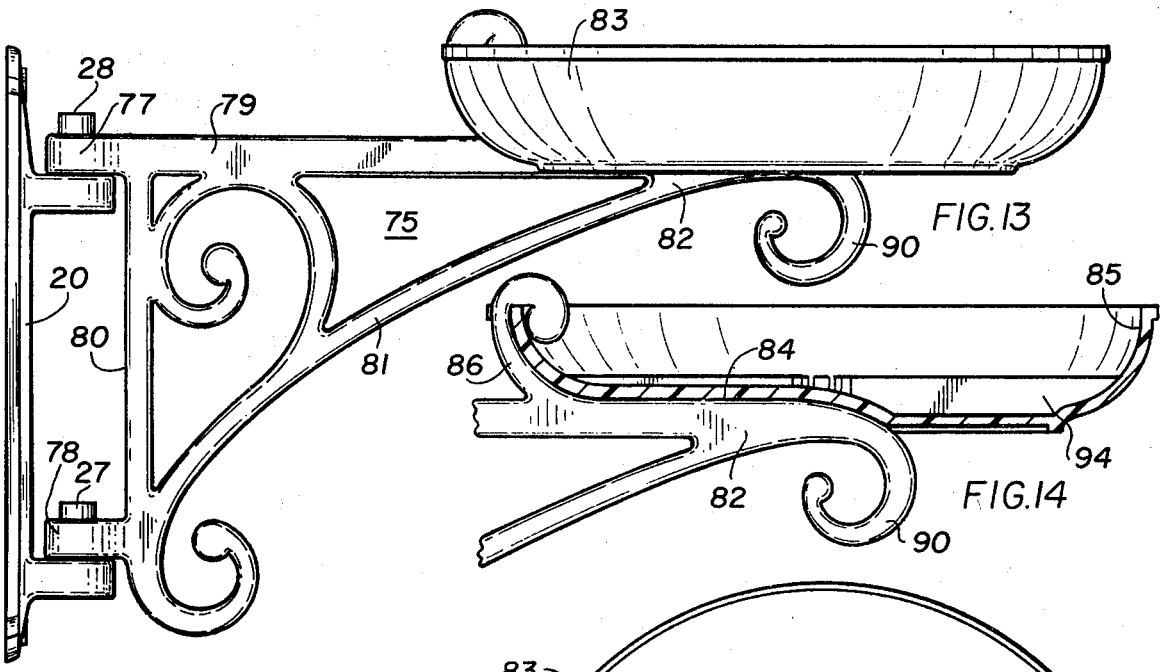
FIG. 13
FIG. 14
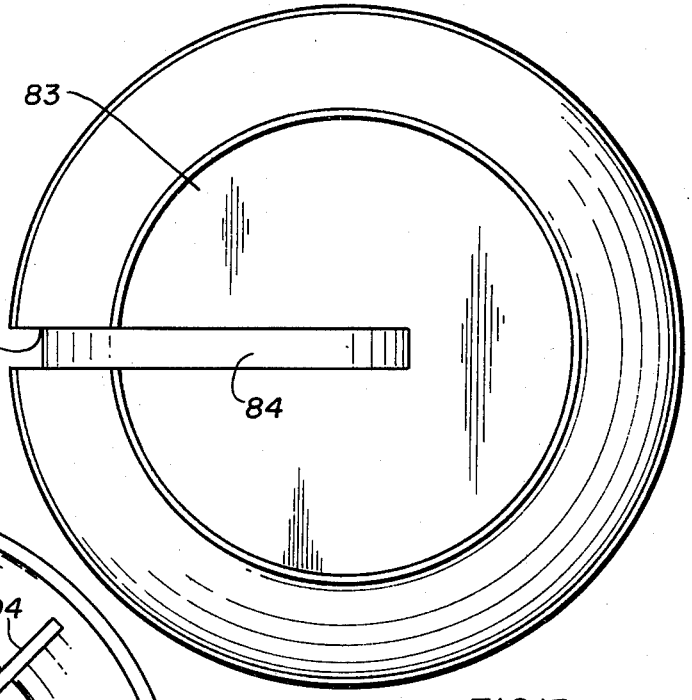
FIG. 15
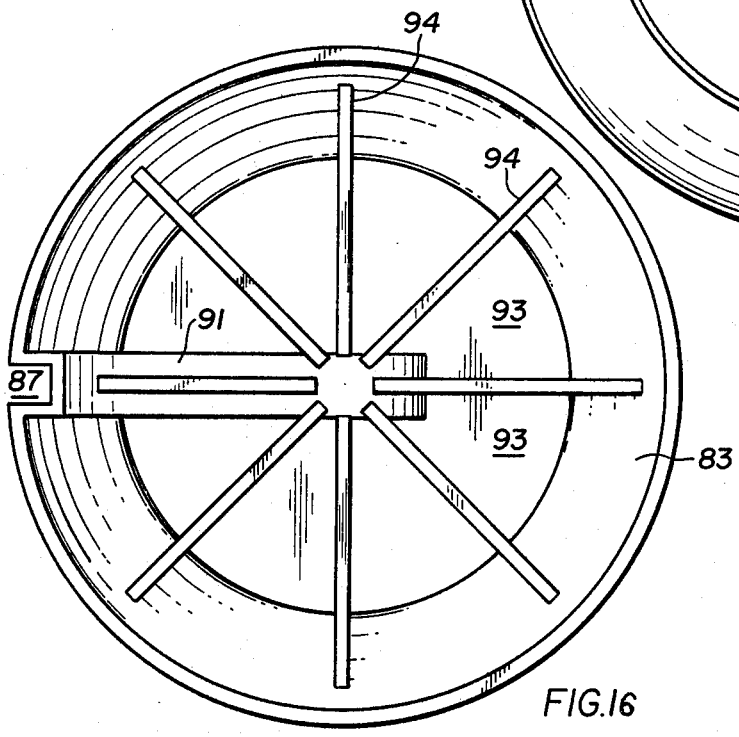
FIG. 16

WALL BRACKET ASSEMBLY

This invention relates to wall brackets, and is particularly directed to the provision of a pivotable universal wall bracket assembly.

Wall bracket assemblies of many types are well known, for the hanging, for example, of plants or the like. The present invention is directed to the provision of a wall bracket assembly especially adapted for the hanging of plants or the like in a home. The invention is thus directed to the provision of particularly unique features that adapt the assembly universally to such use, as well as to provide a pleasing appearance.

In each modification of the wall bracket assembly in accordance with the invention, a wall mounting plate is provided having a pair of vertically spaced apart mounting pins, the wall plate being adapted to be mounted on a wall by conventional means.

In each embodiment of the invention, a bracket arm is also provided, a bracket arm generally having a triangular configuration with a pair of projections at its base adapted to pivotally engage the pins of the wall plate. The lower of the pins on the wall plate is noncircular, and each of the holes in the bracket arm is also noncircular of the same cross section, so that bracket arm may be held in any given angular displacement due to the engaging of the noncircular sections of the pin and holes, but that the bracket arm may be rotated merely by lifting it up and rotating it about the pivotal axis thereof.

In accordance with a further feature of the invention, one of the pivot pins is longer than the other, to facilitate the engagement of the bracket arm with the wall plate. The pivot pins are also of a sufficient length that the noncircular portion of the lower pivot pin may be disengaged, without complete disengagement of the pins of the wall plate and the apertures of the bracket arm.

In one embodiment of a hanger for the bracket arm, a pair of opposed vertically extending grooves are provided on opposite sides of the end of the bracket arm, these grooves being adapted to receive correspondingly shaped internal ridges of a hanger device. The bracket arm may be pivoted to the wall plate either in an upright or inverted position, and the hanger may thus be placed over the end of the bracket arm and locked to the grooves in either of these positions. The hanger may advantageously be provided with either a swivel hook or a ring. In a further feature, for example if a ring is employed, the ring may be pivoted to the hanger so that its upper end engages the bracket arm, to permit assembly of the hanger on the bracket arm only when the ring is pivoted upwardly from its lowermost position.

In accordance with a further embodiment of the invention, a saucer is provided for mounting on the top of the bracket arm. The saucer may advantageously be employed, for example, for supporting a flower pot or the like. The saucer has a bottom groove of a cross section corresponding to the top of the bracket arm, so that the top end of the bracket arm may be received therein. In addition, a hooked shaped projection is provided on the top of the bracket arm, the hooked shaped projection extending over the rim of the saucer, to lock the saucer in place.

In accordance with the invention, since the wall plates are all of the same type, they may be employed interchangeably with the bracket arms. This enables, for example, the permanent mounting of wall plates on the walls of a home, both inside and out, so that a plant may be hung either inside or outside, as desired, without the necessity for removing or installing a further wall plate. The bracket assemblies in accordance with the invention are especially adaptable to production by die casting techniques, so that any desired ornamental features may be provided. This feature enhances their usefulness in the decoration of homes.

In order that the invention will be more clearly understood, it will now be disclosed in greater detail with reference to the accompanying drawings, wherein:

FIG. 13 is a side view of a further modification of the invention, including a wall plate, bracket arm and saucer;

FIG. 14 is a partially cross sectional view of a portion of the assembly of FIG. 13;

FIG. 15 is a bottom view of the saucer of FIG. 13;

FIG. 16 is a top view of the saucer of FIG. 13.

Figures 1, 2, 3, 4, 6:
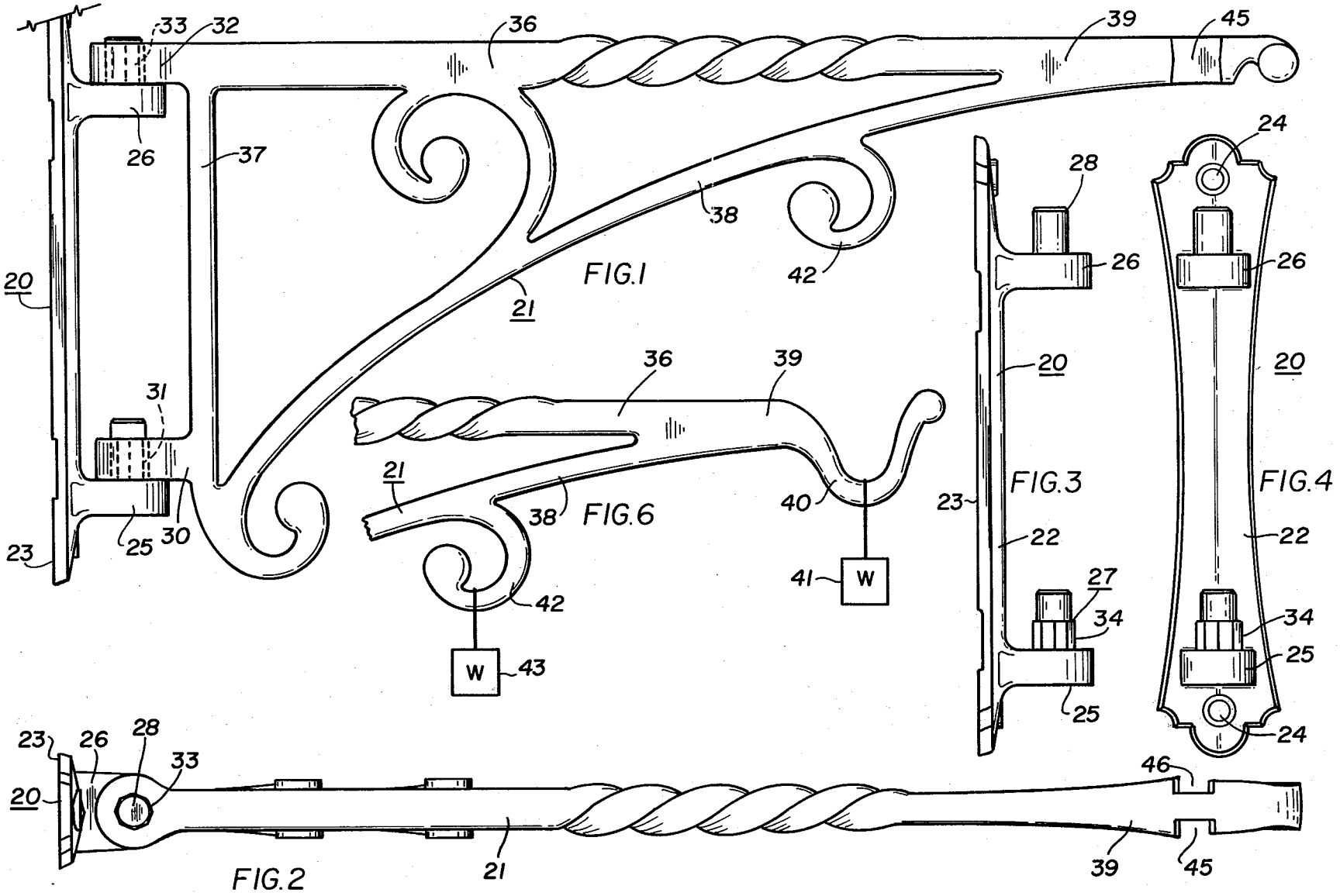
FIG. 1 is a side view of a wall plate and bracket arm in accordance with the one embodiment of the invention.
FIG. 2 is a top view of the assembly of FIG. 1.
FIG. 3 is a side view of the wall plate of FIG. 1.
FIG. 4 is a front view of the wall plate of FIG. 3.
FIG. 6 is an enlarged view of a modification of the end of the bracket arm of FIG. 1.

Referring now to the drawings, and more in particular to FIGS. 1 and 2, a portion of a wall bracket assembly in accordance with the invention, is comprised of a wall plate 20, and a bracket arm 21 removably held on the wall plate 20. The wall plate 20, as shown in FIGS. 3 and 4, is comprised of a base member 22 having a wall mounting surface 23. The wall plate 20 is mountable on a wall by conventional means, such as by screws or the like extending through apertures 24, so that a lower projection 25 and an upper projection 26 of the base are vertically aligned. A lower pivot pin 27 extends upwardly from the projection 25, and an upward pivot pin 28 extends upwardly from the upper projection 26. The pivot pins 27 and 28 are vertically aligned, and extend parallel to the mounting surface 23. It will be particularly noted that the lower pivot pin 27 is slightly longer than the upper pivot pin 28, for a purpose that will be discussed in greater detail in the following paragraphs. In addition, in the preferred embodiment of the invention, the lower portion of the lower pivot pin 27 has a cross section in the form of a regular polygon, such as an octagon, with the top portion of this pivot pin having a circular cross section. The upper pivot pin 28 is preferably of circular cross section throughout its extent.

Figures 5, 7, 8, 9:
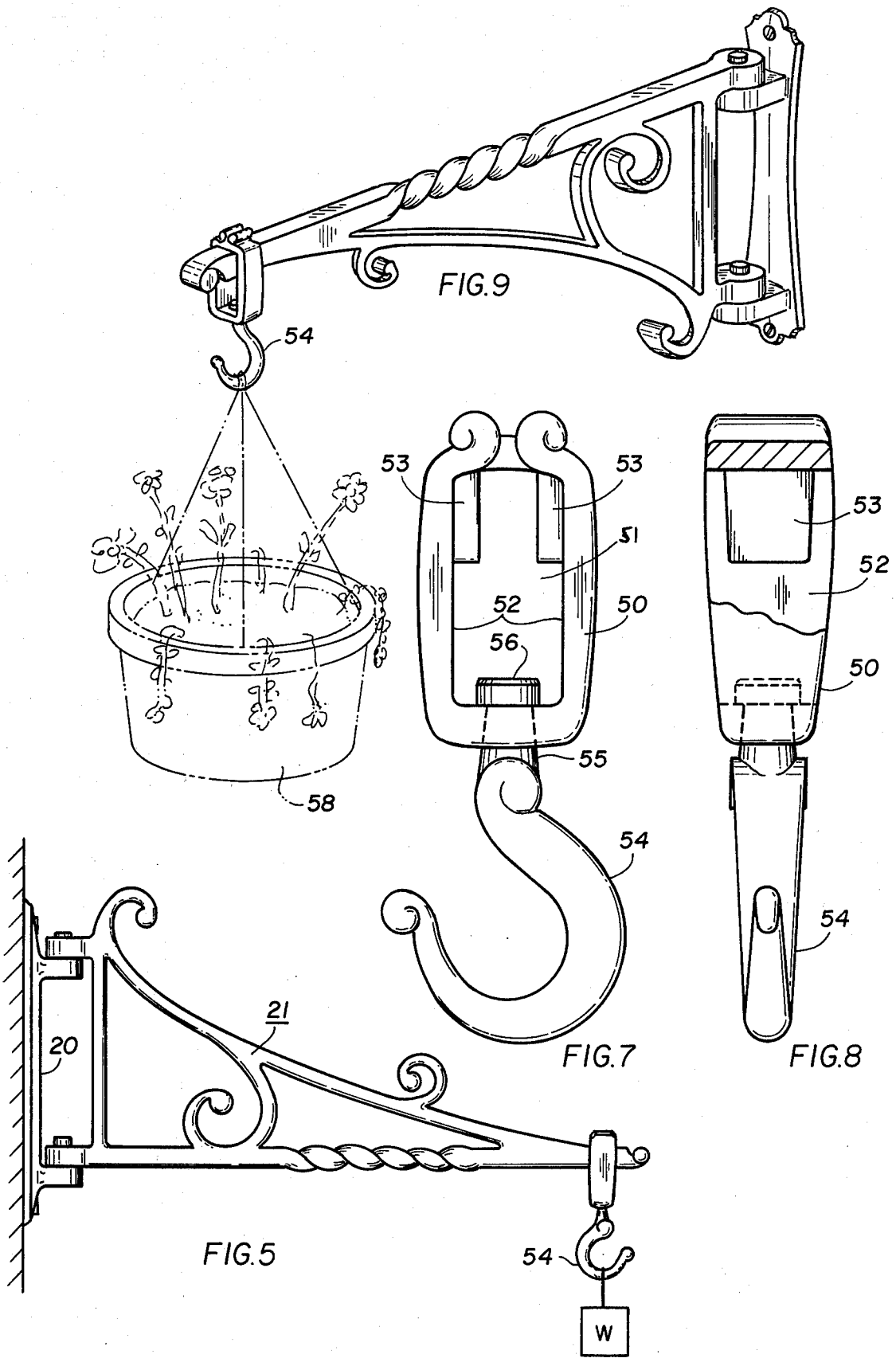
FIG. 5 is a side view of reduced sides of the assembly of FIG. 1, with the bracket arm in inverted position, and carrying a hanger.
FIG. 7 is a front view of one embodiment of a hanger in accordance with the invention.
FIG. 8 is a partially cross sectional side view of the hanger of FIG. 7.
FIG. 9 is a perspective view of the hanger bracket assembly of FIG. 1, including the hanger of FIGS. 7 and 8.

The bracket arm 21, as illustrated in FIGS. 1 and 2, is provided with a lower projection 30 having an aperture 31 and an upper projection 32 having an aperture 33. The apertures 31 and 33 are aligned, and the projections 30 and 32 are spaced so that the apertures 31 and 33 may be fit over the pins 27 and 28 respectfully. The apertures 31 and 33 have noncircular cross sections, i.e., cross sections of the shape of the noncircular cross section portion 34 at the bottom of the lower pin 27. In the preferred embodiment of the invention, the bracket arm 21 is generally triangular, having a horizontal portion 36 generally at the level of the upper projection 32, a vertical portion 37 from which the projections 30 and 32 extend, and a further portion 38 extending generally from the region of the projection 30 to the end portion 39 of the upper arm 36. It will of course be apparent that other configurations may be employed for the bracket arm of the invention. In the arrangement of FIG. 1, the generally horizontal arm 36 is, as discussed above, at the level of the upper projection 32. It is a feature of the invention, that the bracket 21 may alternatively be mounted on the wall plate 22 in inverted fashion, as illustrated in FIG. 5. This feature is possible since the pivot pins are provided on the wall plate, instead of on the bracket 21. The invention thereby enables the user to select the position of the bracket that is most aesthetically desirable for a given situation.

Due to the use of pivot pins 27 and 28, the bracket 21 may be laterally angularly displaced to desired positions. The non-circular portion at the base of the lower pivot pin 27, and the corresponding non-circular shape of the cross sections of the apertures 31 and 33 enable the bracket 21 to be selectively held at any of a number of fixed angular displacements. For example, if the non-circular cross section portion 34, and the apertures 31 and 33, are octagonal, the bracket may be set to any of three angular positions as well as two positions parallel to and adjacent the wall. While it is preferred that the portion 34 of the pivot pin have a cross section in the shape of a regular polygon, it will of course be apparent that other non-circular locking configurations may be employed to enable the holding of the bracket laterally at a number of fixed positions. It is of course unnecessary for the upper pivot pin 28 to have any non-circular portion. As further discussed above, it is preferable that the lower pivot pin 27 be longer than the upper pivot pin 28. This enables the bracket 21 to be mounted on the pins more readily. For example, the user may engage the lower aperture 31 of the bracket with the lower pin 27, initially, without being concerned about the alignment between the pin 28 and the aperture 33. Upon engagement of the lower pin and aperture, then the operator may more readily slip the upper aperture over the upper pin. In an actual embodiment of the invention, for use with brackets having vertical dimensions of 0.35 inches at the projections 30 and 32, the lower pin 27 had a height of 0.5 inches, while the upper pin had a height of 0.406 inches. The height of the non-circular portion 34 is also preferably less than the height of the projections of the bracket. This enables the operator to lift the bracket and rotate it to another angular position, without completely disengaging the bracket apertures from the pivot pins. Thus, in the above example, the height of the non-circular portion 34 of the pivot pin 27 was 0.25 inches.

Referring now to FIG. 6, the end 39 of arm 21 may be provided with a conventional hook 40 formed therein. This enables the hanging of any desired object 41, such as a plant, from the bracket. As illustrated in FIGS. 1 and 6, the lower portion 38 of the bracket arm 21 may be provided with one or more hooks 42, so that additional objects 43 may also be suspended from the bracket arm, spaced from the end thereof, to accommodate staggered loads. This enables the use of the bracket arm 21, as an example, to aesthetically arrange a number of plants from a single bracket arm.

While the hook 40 on the end of the bracket arm is suitable if the bracket arm is only to be employed in the position illustrated in FIG. 1, it obviously would not be satisfactory if the same bracket arm were to be employed alternately in the inverted position as illustrated in FIG. 5. Accordingly, in accordance with the invention, a separable hanger may be provided on the end of the bracket arm, so that the bracket arm may be satisfactorily employed in either of the positions illustrated in FIGS. 1 and 5. Referring to FIGS. 1 and 2, for this purpose the end 39 of the bracket arm is provided with vertically extending opposed grooves 45 and 46, i.e., the grooves 45 and 46 extend generally parallel to the pivotal axis of the bracket arm. One embodiment of a hook structure that may be suspended from the thus described bracket arm, is illustrated in FIGS. 7 and 8. This hanger is comprised of a frame 50 having an aperture 51 extending therethrough. The sides 52 are spaced apart a distance substantially equal to the width of the end of the bracket arm. A pair of opposed ridges extend inwardly in the aperture adjacent the top of the frame from the sides 52 thereof. The ridges 53 have thicknesses substantially equal to the depth of the grooves 45 and 46 of the bracket arm, and are shaped to fit into the grooves 45 and 46.

The hanger illustrated in FIGS. 7 and 8 is further provided with a swivel hook 54 pivoted to the bottom arm of the frame 50. The swivel hook 54 preferably has a tapered pin 55 extending upwardly therefrom through a similarly shaped aperture in the bottom of the frame 50, with the pin 55 having an enlarged upper end 56 to inhibit removal of the swivel hook from the frame. The frame 50 and hook 54 may advantageously be cast together in a two step die casting process, such as disclosed, for example, in copending U.S. patent application Ser. No. 630,277, Einhorn et al, assigned to the assignee of the present application.

The aperture 51 must have a height sufficient to enable the frame to be fitted over the end 39 of the bracket arm, and since the ridges 53 extend inwardly in the aperture, it is evident that the height of the aperture 51 below these ridges must be at least equal to the height of the end 39 of the bracket arm. This dimension must of course be increased due to the extension of the enlarged head 56 of the swivel hook into the aperture.

When it is desired to employ the bracket arm 21 in the position illustrated in FIG. 1, the hanger of FIGS. 7 and 8 is slipped over the end of the bracket arm, until the ridges are above and aligned with the grooves 45 and 46. The hanger is then moved downwardly to allow these ridges to slip into the grooves. This engagement between the grooves and the ridges enables the hanger to be held adequately securely on the end of the bracket arm, so that it will not be displaced, for example, in the normal process of removing an object from the hook, or placing an object on the hook. The hanger may only be removed by first raising it so that the ridges 53 clear the top of the bracket arm. This mounting of the hanger, FIGS. 7 and 8, is clearly illustrated in the perspective view of FIG. 9, wherein the swivel hook 54 is illustrated as suspending a flower pot 58.

Since the grooves 45 and 46 extend completely along their respective sides of the bracket arm, it is apparent that the hanger of FIGS. 7 and 8 may also be held on the end of the bracket arm in the inverted position, as illustrated in FIG. 5. The assembly of the hanger on the bracket arm in this case is of course similar to that when the bracket was not inverted.

It will be noted in FIG. 8 that the sides of the ridges 53 are tapered, and it will also be noted in FIGS. 1 and 2 that the sides of the grooves 45 and 46 are tapered. Specifically, as is apparent in FIG. 1, the groove 45 is tapered so that its width is greatest at the upper and lower surfaces of the bracket arm, and the smallest at the center of the bracket arm 21. The groove 46 is similarly tapered. This feature enables the ridges 53 to be wedged into the grooves 45 and 46, to more firmly hold the hanger in position, regardless of whether the hanger is in the position illustrated in FIG. 1, or the inverted position as illustrated in FIG. 5. The showing of the tapering of the grooves in FIG. 1 is exaggerated, and it has been found that a taper of two degrees is adequate for the above purpose.

Figure 10:
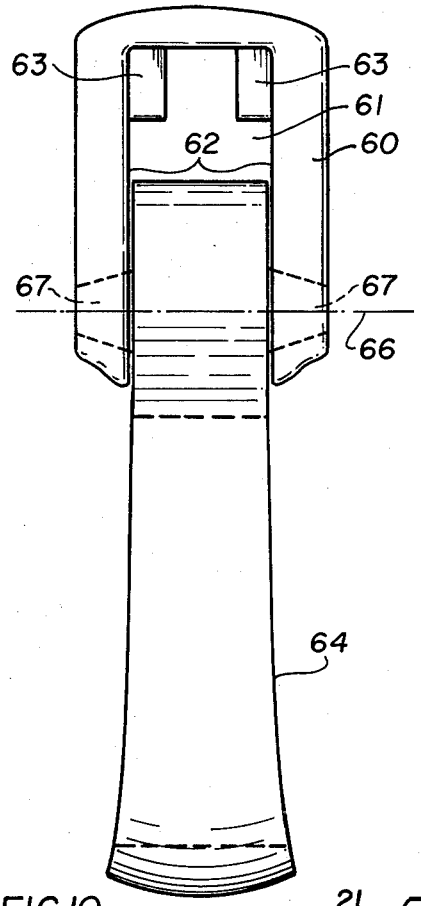
FIG. 10 is a front view of a modified form of hanger.
Figure 11:
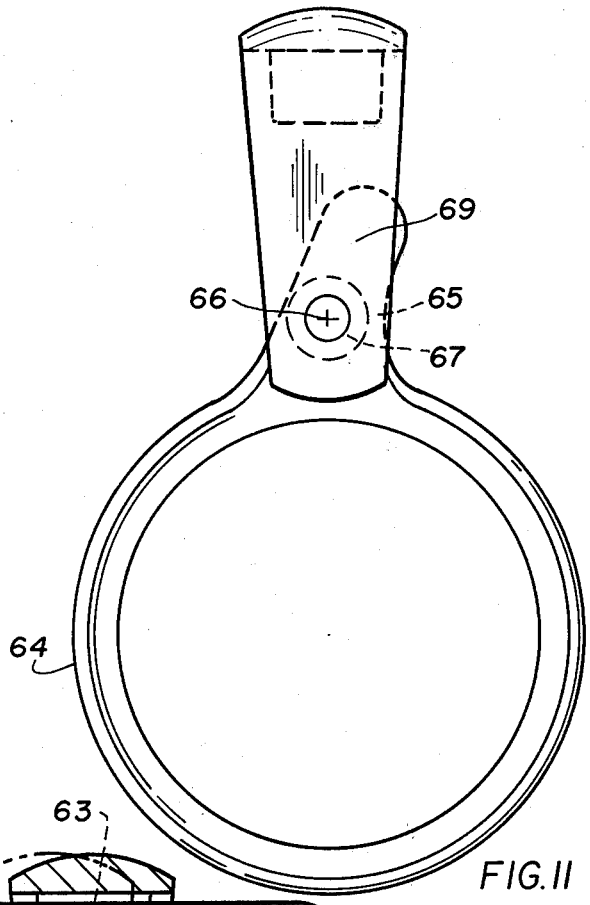
FIG. 11 is a side view of the hanger of FIG. 10.
Figure 12:
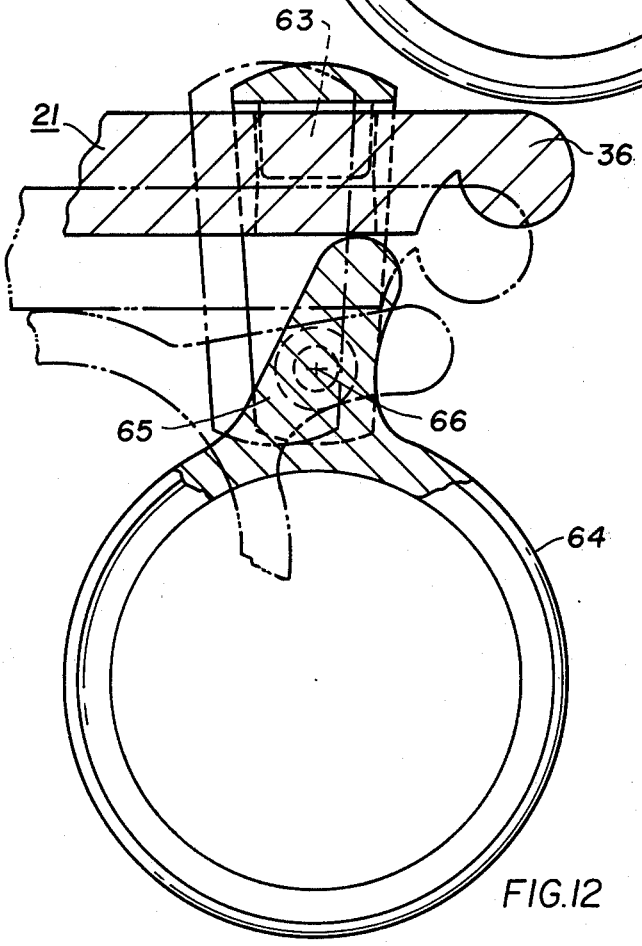
FIG. 12 is a partially cross sectional view of the hangers of FIGS. 10 and 11, showing a locked position of the hanger on the bracket arm in solid lines, in a partially assembled positioning of the hanger in dash-dot lines.

In a further embodiment of a hanger in accordance with the invention that may be employed in combination with the above described bracket arm, as illustrated in FIGS. 10–12, a frame 60 is provided in a manner similar to the frame 50 of FIG. 7, but without any bottom bridge. The frame 60 has an aperture 61 extending therethrough, with the opposite sides 62 of the aperture being spaced apart a distance substantially equal to the width of the bracket arm. A pair of inwardly extending ridges 63, similar to the ridges 53 of the arrangement of FIGS. 7 and 8, are provided in opposed positions on opposite walls 62 of the aperture, at the top of the aperture.

In the arrangement of FIGS. 10–12, a ring-shaped member 64 has a projection 65 depending from its upper rim, and a pivotal axis 66 for the ring shaped member extends through the projection 65 and parallel to the axis of the ring shaped member 64. In the embodiment of the invention illustrated in FIGS. 10–12, a pair of conical projections 67 are provided on the projection 65 coaxial with the axis 66 and on opposite sides of the projection 65. These conical projections extend into similarly shaped apertures in the bottom walls 62 of the frame 60, in order to enable the ring shaped member 64 to be pivoted with respect to the frame.

The pivotal joint of the hanger of FIGS. 10–12 may advantageously be formed in a two step die casting process, such as disclosed, for example, in U.S. Pat. No. 3,742,555, Hannes.

The projection 65 of the ring shaped member 64 extends upwardly beyond the pivotal axis 66, and terminates in a generally rounded end 69 extending into the aperture 61. The end 69 of the projection serves the purpose of locking the hanger on the bracket arm 21. Thus, as illustrated more clearly in FIG. 10, with the ring shaped member 64 in its downwardly extending position, as shown in solid lines, the upper end of the rounded projection 69 is spaced from the bottom of the end 39 of the bracket arm a distance less than the height of the ridges 63. As a consequence, it is apparent that upward movement of the ring shaped member 64 with respect to the bracket arm will result in engagement between the projection end 69 and the bottom of the bracket arm before the ridges 63 are released from the grooves in the bracket arm. The ring shaped member 64 may therefor neither be removed from the bracket arm, nor assembled on the bracket arm, when the ring shaped member is in its lowermost position. When the ring shaped member is rotated about its pivotal axis 66, however, as illustrated in dash-dot lines in FIG. 12, it is apparent that the bracket arm 21 may be moved relatively downwardly with respect to the ring shaped member, a sufficient distance to clear the ridges 63. As a consequence, the ring shaped member may be assembled on the bracket arm, or removed from the bracket arm, by pivoting the ring shaped member upwardly, and then lifting the ring shaped member with respect to the bracket arm to enable the ridges 63 to clear the grooves in the bracket arm.

While the embodiment of the invention illustrated in FIGS. 10–12 specifically provides a ring shaped member 64, it is apparent that this configuration may be varied, and a hook may alternatively be employed.

The embodiment of the invention illustrated in FIGS. 10–12 may be employed, for example, to support a pole or rod. Thus, a pair of bracket assemblies of the type illustrated in FIG. 1 may be mounted in the same horizontal plane, with each being provided with a hanger of the type illustrated in FIGS. 10–12. A rod or pole may then be inserted to extend through the holes in the ring shaped members of the two hangers, for support. The locking arrangement as above described serves the useful function that a pole thus suspended cannot accidentally be dislodged due to unintended removal of the ring shaped members from the bracket arms.

The bracket assembly of FIGS. 1 and 2 may alternatively be employed as shelf brackets, if desired, in which case, a pair of the bracket assemblies may be mounted in spaced apart relationship on a wall, in order to support a shelf placed on the horizontal arms thereof. The use of the bracket arms in this manner as shelf supports does not interfere with their use in supporting hangers of the type illustrated in FIGS. 7, 8 and 10–12, so that the bracket arms may simultaneously serve as shelf supports, and support for objects suspended by hangers on the ends of the arms.

In a still further embodiment of the invention, as illustrated in FIG. 15, a wall plate 20 identical to that employed in the other embodiments of the invention is used. The bracket arm 75 in this embodiment of the invention is somewhat similar to those previously described, in the sense that it has a pair of projections 77 and 78 with non-circular apertures therein and adapted to be pivotally mounted on the pivot pins 27 and 28 of the wall plate. The bracket arm 75 further has a generally horizontal upper arm 79, preferably at about the level of the projection 77, a vertical portion 80 extending generally between the projections 77 and 78, and an inclined portion 81 extending generally between the region of the projection 78 and the outer portion 82 of the bracket arm.

The bracket arm illustrated in FIG. 13 is adapted to support a saucer 83 which may be employed, for example, as a plant stand. The saucer 83 is preferably, although not necessarily round, and has a groove 84 in its bottom surface. The groove 84 has a width substantially equivalent to the width of the end 82 of the bracket arm 75, so that the saucer may be mounted on top of the arm, with the end of the bracket arm extending upwardly into the groove as illustrated in FIGS. 13 and 14. The groove 84 preferably does not extend completely diametrically across the saucer, as illustrated in FIGS. 14 and 16, although this extent of the groove is not critical in the design of the saucer.

The saucer 83 has upturned edges 85, and a hook 86 is formed on the top of the bracket arm 75 on the side of the saucer toward the pivotal axis of the bracket arm. The hook 86 extends across the top of the rim of the saucer, and thence downwardly in the saucer to enage the inside of the rim of the saucer at at least one point. As a consequence, in order to assemble the saucer on the top of the bracket arm, it is necessary to tilt the saucer about a horizontal axis, to enable the edge of the saucer to be slipped under the hook 86. The saucer may then be returned to a horizontal position, with the top of the end 82 of the bracket arm entering and engaging the groove 84 in the bottom of the saucer. In the embodiment of the invention illustrated in FIGS. 13–16, the end 82 of the bracket arm, and consequently the groove 84, preferably have rectangular cross sections. Such a cross section aids in preventing the tilting of the saucer on the bracket arm. In addition, it is preferable that the groove 84 have an extension 87 in the rim of the saucer. The extension 87 of the groove is shaped to fit the hook 86, so that, as illustrated in FIG. 13, the portion of the hook 86 adjacent the outside of the saucer may extend completely in the groove extension 87. The groove extension 87, aside from providing an esthetically pleasing appearance since it hides the hook 86, also aids in the support of the saucer. Thus, since the sides of the hook 86 engage the sides of the groove 87, the saucer is completely prevented from tilting about a horizontal axis parallel to the arm 79. Further, since the top of the rim of the saucer engages the underside of the top of the hook 86, the back of the saucer is prevented from tilting upwardly, about a horizontal axis extending transversely of the arm 79. As a consequence, a load placed in the saucer at a point beyond the end of the arm 79 will not affect the tilting of the saucer.

As illustrated in FIGS. 13 and 14, the arm 79 preferably extends at least half way across the bottom of the saucer, to provide adequate support. Such extension is not necessary, however, to avoid tilting.

It is further to be noted that upward tilting of the outer edge of the saucer in the vertical plane of the arm 79 is prevented, since such tilting would normally result from downward forces on the inside of the saucer in the region thereof overlying the arm 79, and the arm 79 hence prevents such tilting.

For esthetic appearances of the assembly of FIGS. 13 and 14, as well as for utilitarian purposes, a hook 90 of pleasing appearance may be formed on the outer end 82 of the bracket 75. Thus, the hook 90 may also be employed to suspend articles from the bracket arm. If desired, as illustrated in FIG. 14, the hook 86 may be fixed to be similar to the hook 90, so that the bracket assembly has a pleasing appearance when the saucer is not positioned on the bracket arm.

As illustrated more clearly in FIG. 15, the groove 84 and its extension 87 may be formed by forming a ridge 91 in the bottom of the saucer. The bottom of the saucer is separated into a plurality of separate compartments 93, by rims 94, for example, radially extending rims as illustrated in FIG. 15. These compartments serve as reservoirs to prevent plants from getting "wet feet" (damping off), while capturing spilt water when a plant in a pot on the saucer is watered. In addition, the compartments 93 may be filled with water, in order to increase humidity around the plant for healthy growth.

The arrangement of the invention as illustrated in FIGS. 13–15 thereby enables the provision of a rigid assembly, wherein a saucer for supporting a plant or other objects may be releasably affixed to a bracket assembly, in order to enable the mounting of a plant of the like on a wall. It is of course apparent that the saucer may be employed independently of the bracket, for example, as a conventional saucer for a plant. In addition, the bracket arm 75 may be employed independently of the saucer 83, for example, for supporting objects from the hook 90. In addition, since the apertures in the projections 77 and 78 have non-circular cross sections, as in the arrangements of FIGS. 1–4, it is apparent that the bracket arm 75 may be inverted in a manner similar to that illustrated in FIG. 5. It is of course apparent that the saucer cannot be employed on the bracket in the inverted position.

The wall plate 20, bracket arms 21 and 75, and hangers 60 and 70 may be formed by any conventional technique, but are preferably formed by die casting. In order to reduce the weight of the structures, it is preferable to employ a magnesium die casting metal, although zinc die casting metal may also be employed. It is of course apparent that the invention is not limited to the use of either of these materials. In addition, it is preferred that the saucer 83 be formed of a high impact polystyrene, although other thermoplastic materials may alternatively be employed.

The bracket assemblies in accordance with the invention, as above disclosed, provides for a number of variations in techniques for hanging or supporting objects, such as plants or the like. Since a standard wall plate is used in all embodiments of the invention, it is evident that the combinations of elements employed may be varied as is desired.

While the invention has been described and disclosed with reference to a limited number of embodiments, it is apparent that variations and modifications may be made therein, and it therefor intended in the following claims to cover each such variation and modification as falls within the true spirit and scope of the invention.

What is claimed is:

1. A wall bracket assembly comprising a wall plate and a bracket removably held therein, said wall plate comprising a base member having a wall mounting surface, first and second coaxial spaced apart pivot pins extending from said base member, said pins extending parallel to said surface with first ends affixed to said base member and second free ends, the free end of said first pin extending toward said second pin and the free end of said second pin extending away from said first pin, one of said pins being longer than the other of said pins, the longer of said pins having a portion thereof adjacent the first end of said longer pin with a non-circular cross section, said bracket having an article holding arm, and first and second spaced apart aligned projections, said projections having aligned holes with non-circular cross sections of the shape corresponding to the non-circular cross section of said portion of said one pin, said bracket being assembled with said aligned holes pivotally engaging said pins.

2. The wall bracket assembly of claim 1 wherein said one of said pins having a portion with a noncircular cross section has a circular cross section at the free end thereof.

3. The wall bracket assembly of claim 1 wherein the other of said pins has a circular cross section throughout the length thereof.

4. The wall bracket assembly of claim 1 wherein said article holding arm is generally triangular, having a first portion extending substantially normal to the pivotal axis of said arm at one of said holes, and a second portion extending from the region of the other of said holes and joining the first portion at the end thereof away from said wall plate.

5. The wall bracket assembly of claim 1 further comprising a hanger removably held on the end of said arm away from said wall plate.

6. The wall bracket assembly of claim 1 further comprising saucer means removably held to the end of said arm away from said wall plate.

7. A wall bracket assembly comprising a wall plate and a bracket removably held therein, said wall plate comprising a base member having a wall mounting surface, first and second coaxial spaced apart pivot pins extending from said member, said pins extending parallel to said surface with first ends affixed to said base member and second free ends, the free end of said first pin extending toward said second pin and the free end of said second pin extending away from said first pin, one of said pins being longer than the other of said pins, with one of said pins having a portion thereof adjacent its first end with a non-circular cross section, said bracket having an article holding arm, and first and second spaced apart aligned projections, said projections having aligned holes with non-circular cross sections of said portion of said one pin, said bracket being assembled with said aligned holes pivotally engaging said pins, and a hanger removably held on the end of said arm away from said wall plate, the end of said arm away from said wall plate having a pair of grooves on opposite sides thereof extending parallel to the pivotal axis of said arm, said hanger having an aperture with ridges extending internally therein and adapted to engage the grooves of said arm.

8. A wall bracket assembly comprising a bracket arm and a hanger releasably held on said bracket arm, said bracket arm having a portion with first and second parallel grooves extending along opposite sides thereof, and means mounting said bracket arm whereby said grooves extend vertically, said hanger having an aperture of a size to enable fitting of said hanger over said arm, one end of said aperture having a pair of opposed inwardly extending ridges shaped to fit into said grooves of said arm, to restrain said hanger on said arm, the other end of said aperture being free of said ridges in order to enable assembling of said hanger over said arm.

9. The wall bracket assembly of claim 8 wherein said ridges and grooves are tapered.

10. The wall bracket assembly of claim 9 wherein said grooves are narrowest at their centers, and expand toward the top and bottom of said arm, whereby said ridges merely wedge into said grooves from either end thereof.

11. The wall bracket assembly of claim 8 wherein said hanger comprises a frame, said aperture extending through said frame, and a swivel hook pivotally mounted to said frame.

12. The wall bracket assembly of claim 8 wherein said hanger comprises a frame, and a hanging element pivotally mounted to said frame.

13. The wall bracket assembly of claim 12 wherein said hanging element is mounted to said frame for rotation about an axis normal to the plane of said arm, said hanging element having a first portion on the pivotal axis thereof for hanging an article, and a second portion on the other side of the pivotal axis thereof for engaging said arm, whereby said hanging element is locked to said arm when said first portion of said hanging element is pivoted away from said arm.

14. The wall bracket assembly of claim 13 wherein said first portion of said hanging element comprises a ring.

15. A wall bracket assembly comprising an arm, means adapted to mount said arm to extend substantially horizontally, and a saucer removably held on said arm, said saucer having a groove extending at least part way centrally across its bottom side, said saucer being mounted on top of said arm with an end portion of said arm extending upwardly into said groove, said saucer having an upwardly extending rim, said groove having a cross section to closely fit said arm, said arm having a hook shaped portion extending upwardly adjacent said end portion thereof, said hook shaped portion extending over and engaging said rim of said saucer to hold said saucer on said arm.

16. The wall bracket assembly of claim 15 wherein said groove of said saucer extends across the rim of said saucer, whereby said hook shaped portion of said arm is fitted in the portion of said groove extending through said rim.

17. The wall bracket of claim 15 wherein the end portion of said arm at the top thereof has a substantially rectangular cross section, and said groove has a rectangular cross section.

18. The wall bracket assembly of claim 15 wherein said groove in the bottom of said saucer defines a ridge on the inside of said saucer.

* * * * *

UNITED STATES PATENT OFFICE
CERTIFICATE OF CORRECTION

Patent No. 4,071,216 Dated January 31, 1978

Inventor(s) Ruediger Einhorn

It is certified that error appears in the above-identified patent and that said Letters Patent are hereby corrected as shown below:

In the Title Page, under "Assignee": "Clarke" should be --Clark--.

Column 3, line 6: "respectfully" should be --respectively--.

Column 8, line 5: "of" (2nd occurrence) should be --or--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*